US007152813B2

(12) United States Patent
Chen

(10) Patent No.: US 7,152,813 B2
(45) Date of Patent: Dec. 26, 2006

(54) CAP WITH A SUCTION TYPE SPRAY HEAD

(75) Inventor: Kwang-Tsan Chen, Taipei (TW)

(73) Assignee: Ding Hwa Co., Ltd., Taipei (TW)

( * ) Notice: Subject to any disclaimer, the term of this patent is extended or adjusted under 35 U.S.C. 154(b) by 163 days.

(21) Appl. No.: 10/938,609

(22) Filed: Sep. 13, 2004

(65) Prior Publication Data

US 2006/0054644 A1 Mar. 16, 2006

(51) Int. Cl.
*A62C 13/62* (2006.01)

(52) U.S. Cl. ..... 239/340; 239/398; 239/354; 239/302; 239/346; 239/348; 239/428.5; 239/419.5; 239/434

(58) Field of Classification Search ..... 239/302, 239/354, 398, 418, 419.5, 428.5, 434, 340, 239/346, 347, 348, 426
See application file for complete search history.

(56) References Cited

U.S. PATENT DOCUMENTS

| | | | | | |
|---|---|---|---|---|---|
| 2,052,869 | A * | 9/1936 | Coanda | 239/418 |
| 2,606,070 | A * | 8/1952 | Vensel | 239/302 |
| 2,612,403 | A * | 9/1952 | Burch | 239/318 |
| 2,616,762 | A * | 11/1952 | Holmes | 239/362 |
| 2,877,838 | A * | 3/1959 | Stadler | 239/417.3 |
| 3,084,870 | A * | 4/1963 | Hagadorn | 239/305 |
| 3,107,058 | A * | 10/1963 | Corbett | 239/346 |
| 3,454,228 | A * | 7/1969 | Mossop | 239/308 |
| 3,770,209 | A * | 11/1973 | Wilcox | 239/434 |
| 3,773,260 | A * | 11/1973 | Kunioka et al. | 239/10 |
| 4,252,512 | A * | 2/1981 | Kornylak | 425/89 |
| 4,963,228 | A * | 10/1990 | Steen | 162/344 |
| 5,402,943 | A * | 4/1995 | King et al. | 239/11 |
| 5,662,271 | A * | 9/1997 | Weston et al. | 239/321 |
| 6,170,758 | B1 * | 1/2001 | Lee | 239/124 |
| 6,264,067 | B1 * | 7/2001 | Lasserre | 222/108 |
| 6,827,293 | B1 * | 12/2004 | Seeman | 239/310 |
| 6,896,203 | B1 * | 5/2005 | Restive | 239/302 |
| 2003/0075618 | A1 * | 4/2003 | Shimazu | 239/381 |
| 2004/0026535 | A1 * | 2/2004 | Conway et al. | 239/433 |

FOREIGN PATENT DOCUMENTS

| | | |
|---|---|---|
| TW | 228078 | 8/1994 |

* cited by examiner

*Primary Examiner*—Eric Keasel
*Assistant Examiner*—Trevor McGraw

(57) ABSTRACT

A cap with a suction type spray head includes an air guiding chamber, an intake passage, an outgoing passage, a liquid sucking mouth and an air pressure balancing aperture for a container with a sprayer. The liquid in the container can be sucked out due to air pressure difference between the sucking mouth and the interior of the container. The outgoing passage at the outer end thereof is a spraying outlet, which face the liquid sucking mouth so that the liquid out of the liquid sucking mouth is atomized with the air sprayed from the spraying outlet.

1 Claim, 5 Drawing Sheets

CAP WITH A SUCTION TYPE SPRAY HEAD

BACKGROUND OF THE INVENTION

1. Field of the Invention

The present invention is related to a cap with a suction type spray head and particularly to a cap with a suction type spray head, which is attached to a container of a specific liquid and the liquid can be sucked out by way of air pressure difference and atomized with sprayed air.

2. Brief Description of the Related Art

The traditional cap with spray head of a container for filling with perfume or drug provides a plug ring with a hole being associated with a clearance between the cap and the lateral edge of the mouth of the container being as an intake passage of the compressed air. However, the clearance is hard to be controlled the size thereof so that the liquid is difficult to spray out if the clearance is too small and it is easy to result in leakage of the liquid if the clearance is a little larger. Taiwanese Patent Official Gazette No. 228078 discloses an improved structure of perfume bottle cap with spray head shown in FIG. 5. The air 17 enters the ventilation hole 16 via the air passage 24 and then moves into the perfume bottle 19 along outer side of the sucking tube 15 and the inner rim of the bottle mouth. In this way, the perfume 20 can enter the T shaped air chamber 21, which is in a state of vacuum, via the sucking tube and, finally, the perfume can be spayed out from the nozzle 23 with a state of atomization once the air bag 22 is compressed. The only thing has to be done is to tighten the cap to the upper rim 14 of the bottle mouth with the plug ring 11 and it is not necessary to consider if the clearance between the cap and the lateral edge of the mouth of the container is properly arranged.

Although the preceding technique can overcome the control problem of the clearance, the liquid has to enter the vacuumed air bag via the sucking tube before being sprayed outward from the nozzle by way of compressing the air bag every time the liquid being sprayed. Hence, the effect of continuously spraying the liquid cannot be obtained.

SUMMARY OF THE INVENTION

The present invention provides a cap with suction type spray head, which includes an air guiding chamber, an intake passage, an outgoing passage, a liquid sucking mouth and an air pressure balancing aperture for a container with a sprayer. The air pressure balancing aperture communicates with the open air to allow the air pressure at interior of the container being inconsistent with that at the exterior of the container and the outgoing passage connects with the air guiding chamber at one end thereof and extends outward at another end thereof with a spraying outlet. The air guiding chamber has a discharge port at the periphery of the cap and the liquid sucking mouth is connected to a sucking tube with the other end of the sucking tube being immerged the liquid in the container. Further, the liquid sucking mouth oppositely faces the spraying outlet of the outgoing passage.

The cap with suction type spray head according to the present invention provides a simple structure with easy operation so that the cap can be attached to the container filled with liquid and the intake passage of the cap is connected to a hose, which is joined to a low pressure air compressor as an intake air source. In case of being in operation, the discharge port of the air guiding chamber is blocked by the user to allow the introduced outside air passing through the outgoing passage and spraying out via the spraying outlet. Due to the sprayed air having a fast flow speed with a pressure lower than the static atmosphere pressure and the pressure in the container is inconsistent with static atmosphere pressure, it is learned from Bernoulli's law of fluid mechanics that the liquid in the container can be sucked out from the sucking mouth via the sucking tube because of pressure difference between sprayed air and the liquid. Further, the fluid sucked out of sucking mouth faces the sprayed air from the spraying outlet such that the fluid can be ejected in a state of atomization. In case of not being used, the discharge port is unblocked and keeps in a state of opening such that the introduced outside air is discharged via the discharge port directly instead of passing through the outgoing passage and spraying out from the spraying outlet. In this way, the air pressure at the sucking mouth keeps the static atmosphere pressure instead of being less than the static atmosphere pressure such that no pressure difference is created between the sucking mouth and the interior of the container and the liquid in the container does not flow out.

The cap with a suction type spray head according to the present invention provides no movable parts and no air control valves joining the hose connected to the spray head so that it is not so complicated as the prior art in structure. Hence, the cap with a suction type spray head according to the present invention can made with injection molding as an integral piece to facilitate the operation and lower production cost. Furthermore, the cap with a suction type spray head according to the present invention can be made as a disposable cap such that the cap can be renewed after using instead of cleaning the cap frequently to enhance sanitation.

The cap with suction type spray head according to the present invention has the following features:

1. No movable parts and no air control valve parts joining the hose connected to the spray head are necessary in the cap with suction type spray head according to the present invention while the air is introduced to cap with the spray head. In case of being in operation, the discharge port of the air guiding chamber is blocked by the user to allow the introduced outside air passing through the outgoing passage and spraying out via the spraying outlet and the liquid in the container can be sucked out in a state of atomization. In case of not being used, the discharge port is kept in a state of opening to allow the introduced outside air being discharged via the discharge port directly.

2. The cap with a suction type spray head according to the present invention is used for a specific liquid so that parts for regulating the spray head are not required.

3. The cap with a suction type spray head according to the present invention is attached to the mouth of a container as a cap of the container so that no further cap is required.

4. The cap with a suction type spray head according to the present invention provides no movable parts so that the cap of the present invention can be made with injection molding as an integral cap to lower the production cost greatly and enhance the effect thereof substantially.

5. The cap with a suction type spray head according to the present invention can be made as a disposable cap for being renewed after using once instead of cleaning the cap frequently to enhance sanitation.

6. The cap with a suction type spray head according to the present invention provides a simple structure with easy operation so that it is not necessary for the user to be trained before using.

BRIEF DESCRIPTION OF THE DRAWINGS

The detail structure, the applied principle, the function and the effectiveness of the present invention can be more fully understood with reference to the following description and accompanying drawings, in which.

DETAILED DESCRIPTION OF THE INVENTION

Figure 1:
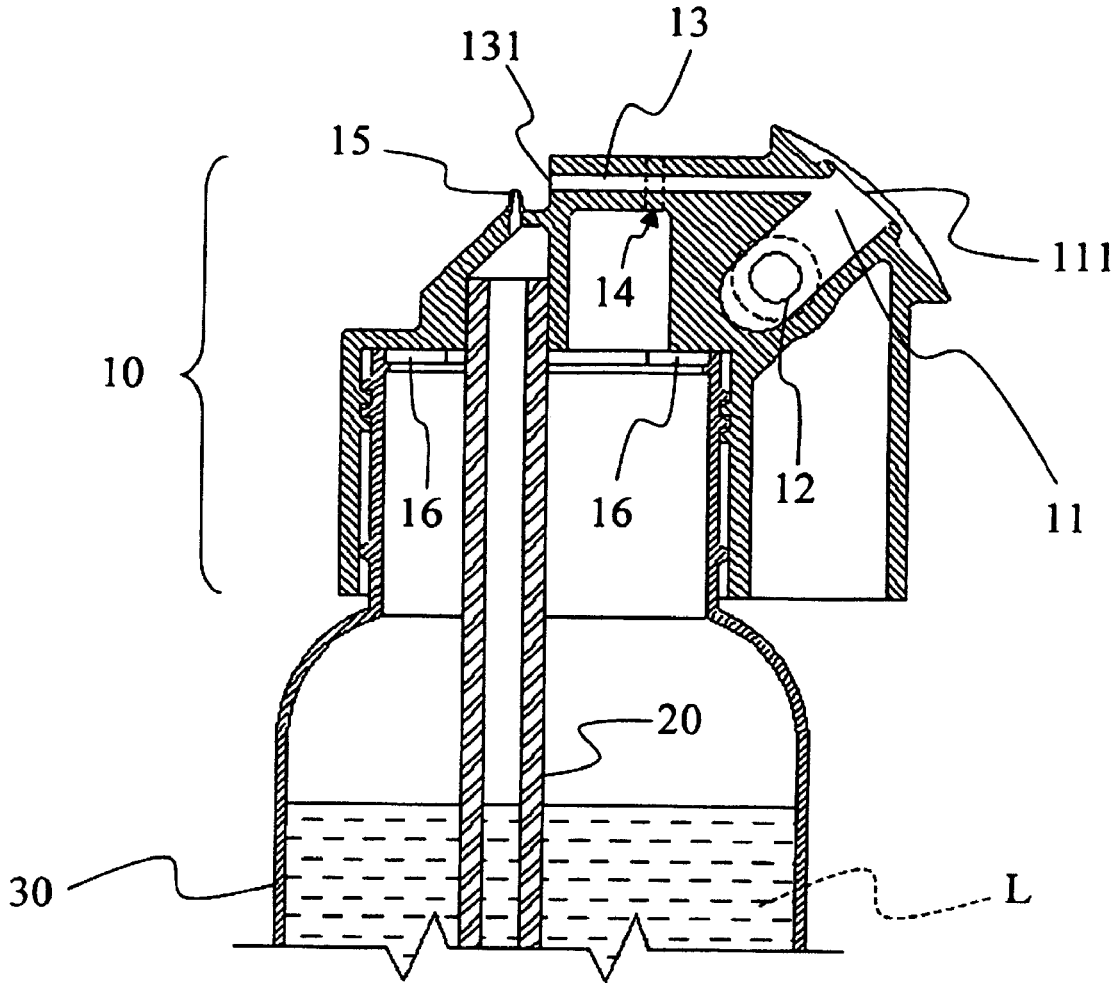
FIG. 1 is a sectional view of the cap with a suction type spray head according to the present invention in a preferred embodiment thereof.

Referring to FIG. 1, a cap structure of a spray head according to the present invention basically provides a cap member 10, which includes an air guiding chamber 11, an intake passage 12, an air outgoing passage 13, an air pressure balancing aperture 14 and a liquid sucking mouth 15. The air pressure balancing aperture 14 is arranged to communicate with outside open air to keep an equilibrium pressure between the exterior and the interior of a container. The air outgoing passage 13 is connected to the air guiding chamber 11 at an end thereof and extends outward to provide an air spraying outlet 131. The intake passage 12 has an inlet at the periphery of the cap member 10 at an end thereof and connects with the air guiding chamber 11 at the other end thereof so that the air intake passage 12 can communicate with the air outgoing passage 13. The air guiding chamber 11 provides a discharge port 111 at the periphery of the cap member 10. The liquid sucking mouth 15 is disposed to face the air spraying outlet 131 and connects with a sucking tube 20, which extends inward a container 30 filled with liquid L, and the outer end of the sucking tube 20 is immerged in the liquid L.

Figure 2:
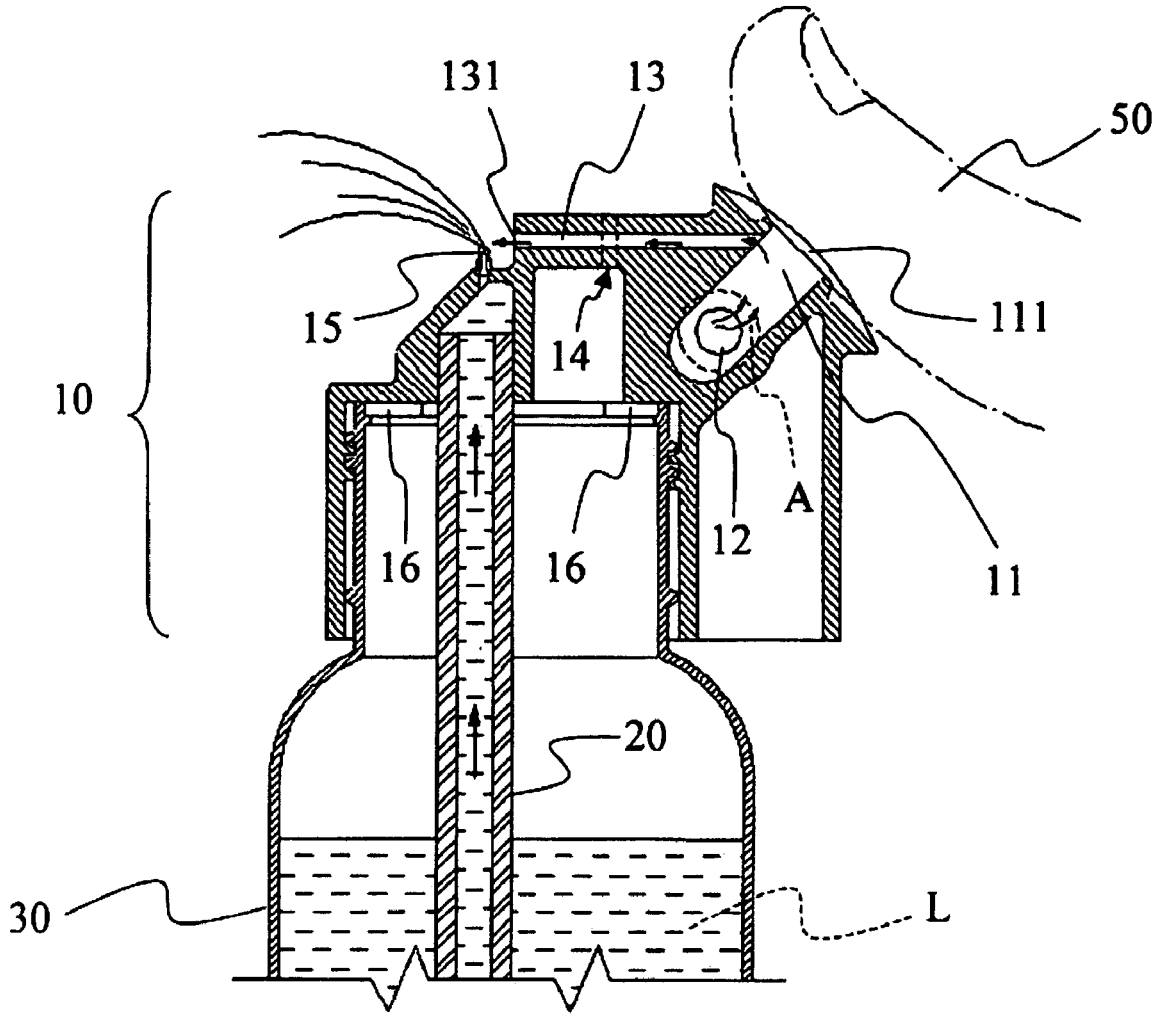
FIG. 2 is a sectional view similar to FIG. 1 illustrating the cap with a suction type spray head according to the present invention being in operation.

Referring to FIG. 2, operation of the cap structure of the present invention is illustrated. The outside open air A is introduced to the air guiding chamber 11 via the intake passage 12 as an intake air source. The user can block the discharge port 111 of the air guiding chamber 11 with a finger 50 to allow the air A introduced to the air guiding chamber 11 passing through the outgoing passage 13 and spraying outward via the air spraying outlet 131. The air spraying outward from the air spraying outlet 131 provides a fast flow speed so that the pressure thereof is less than the static atmosphere pressure liquid. Further, pressure in the container 30 keeps the same as the static atmosphere pressure due to provision of the air pressure balancing aperture 14. Hence, Bernoulli's Law of the fluid mechanics is applied, that is, the pressure difference between the static atmosphere pressure and the air spraying outward from the air spraying outlet 131 can suck out the liquid in the container 30 from the sucking mouth 15 via the sucking tube 20. In the meantime, the air spraying outward from the air spraying outlet 131 faces the out flowing liquid from the sucking mouth 15 such that the sprayed air can atomize the out flowing liquid. When the liquid L in the container 30 is not sucked out, it is only necessary for the user to remove the finger 50 from the discharge port 111 and keep the discharge port 111 in a state of unblocked. In this way, the outside open air is introduced to the air guiding chamber 11 and then discharges from the discharge port 111 instead of passing through the air outgoing passage 13 and spraying outward from the air spraying outlet 131 such that the liquid L in the container 30 is incapable of moving outward due to the pressure at the sucking mouth 15 being the same as that in the container without function of suction.

Figure 3:
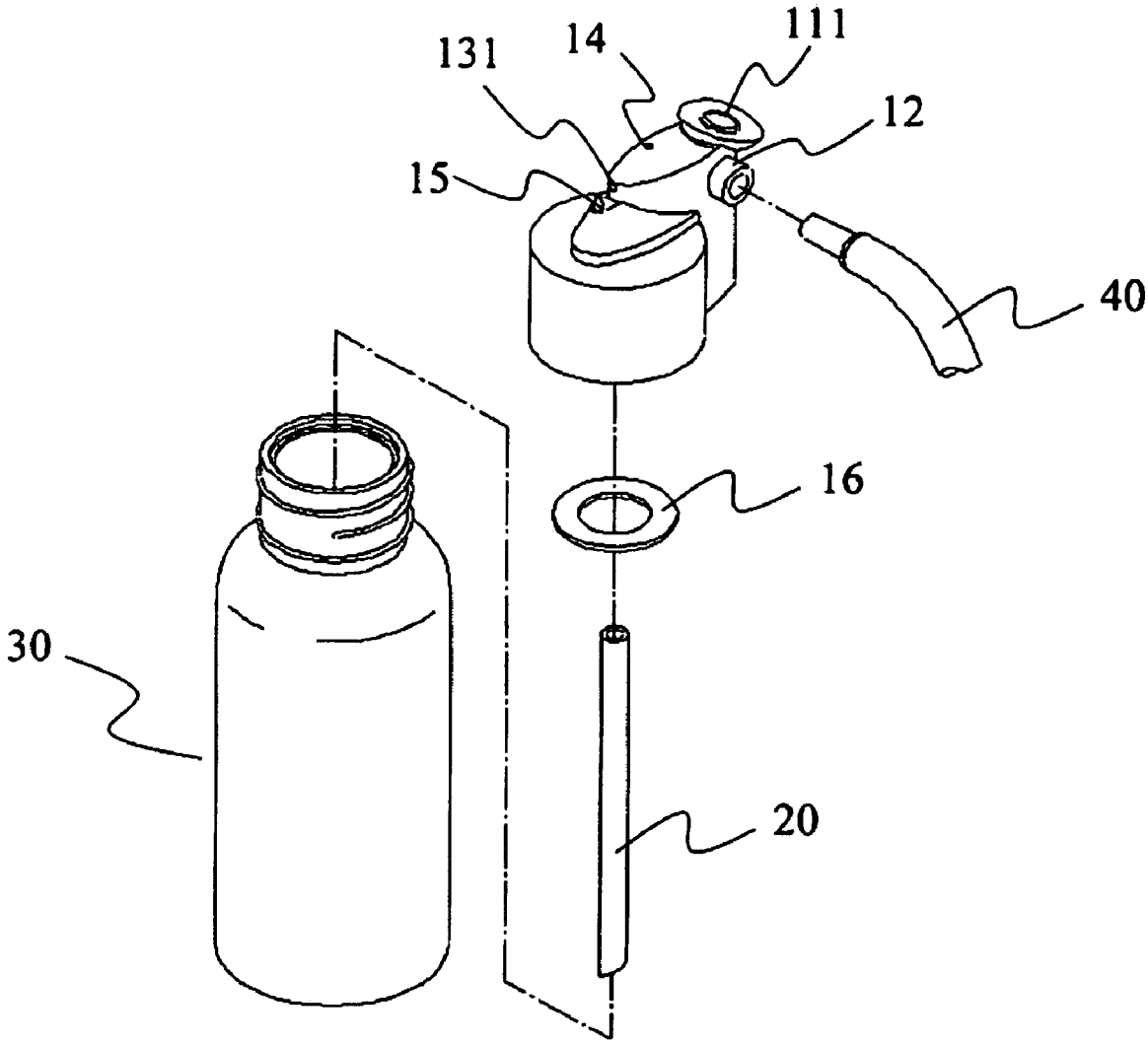
FIG. 3 is a disassembled perspective view of the preferred embodiment according to the present invention.
Figure 4:
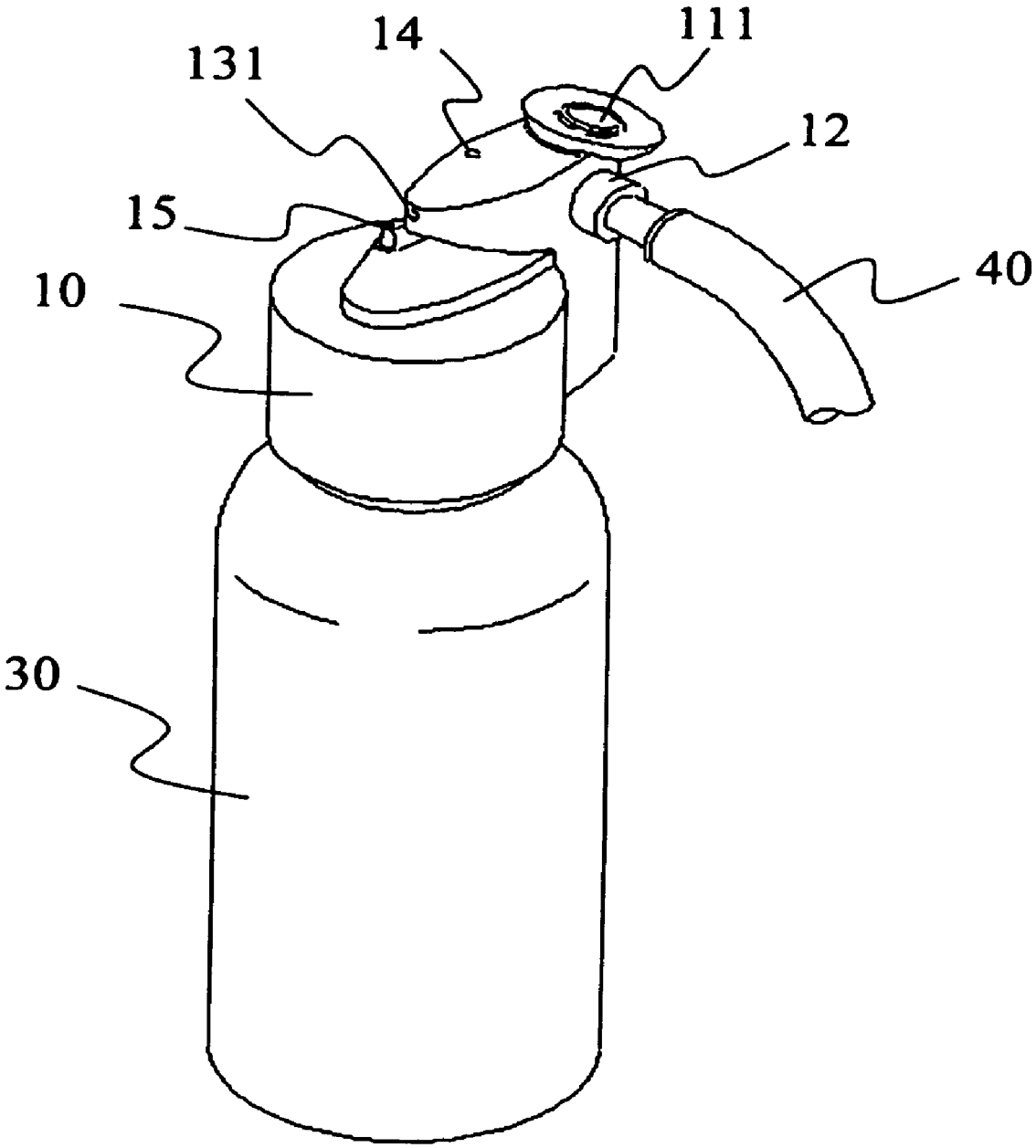
FIG. 4 is an assembled perspective view of the preferred embodiment according to the present invention.
Figure 5:
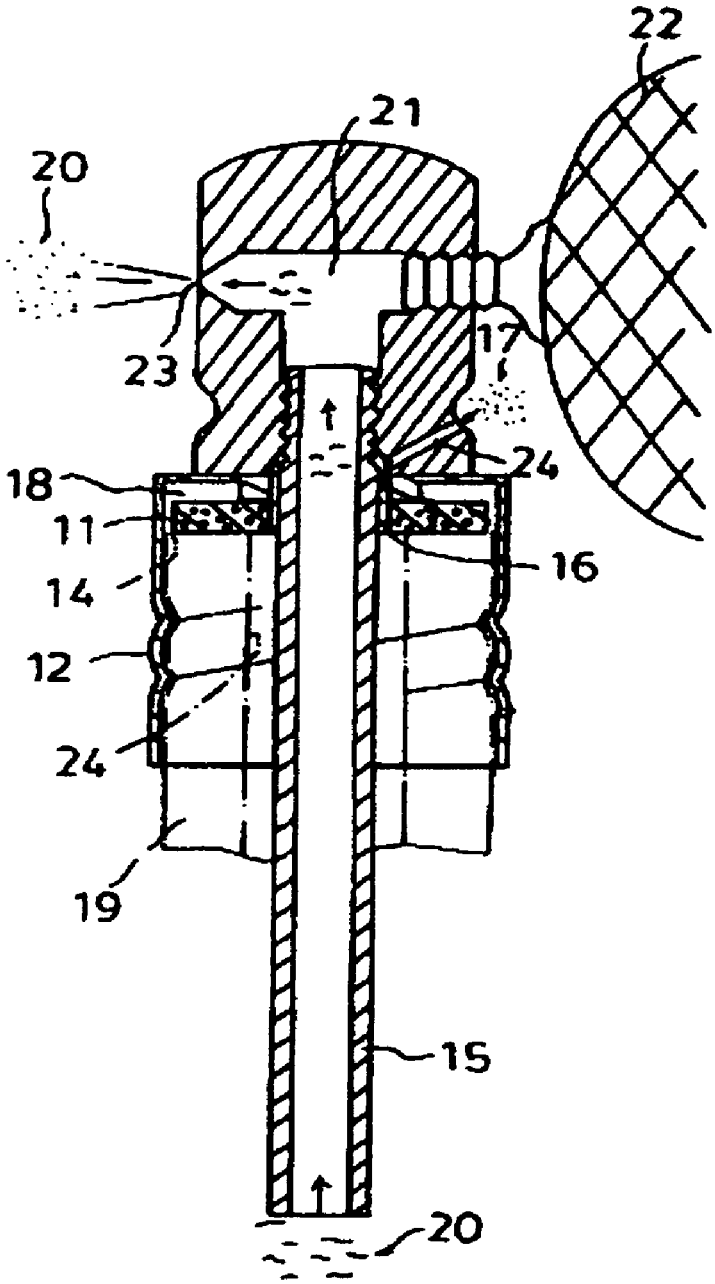
FIG 5 (PRIOR ART)
FIG. 5 is a sectional view of a conventional cap of spray head.

Referring to FIGS. 3 and 4, while in practice, it can be seen clearly that the cap member 10 connects with the sucking tube 20, which extends into the container 30, and an air tight ring 16 is attached to the mouth of the container 30 with an outer air guide hose 40 being connected to the air intake passage 12.

While the invention has been described with referencing to preferred embodiments thereof, it is to be understood that modifications or variations may be easily made without departing from the spirit of this invention, which is defined by the appended claims.

What is claimed is:

1. A cap with a suction type spray head, which is integrally joined to the periphery of the cap, comprising:

an air guiding chamber, being disposed in the suction type spray head and having a discharge port at the top of the suction type spray head;

an air intake passage with two ends, being disposed in the suction type spray head and near the bottom of the air guiding chamber with one of the ends thereof being joined to a lower lateral side of the air guiding chamber and another one of the ends thereof extending outward the suction type spray bead laterally for connecting an air hose;

an air outgoing passage with an air inlet and an air outlet, being disposed in the suction type spray head and near the top of the suction type spray head with the inlet thereof connecting with an upper lateral side of the air guiding chamber and the outlet thereof extending outward to the suction type spray head laterally and being opposite to the discharge port;

an air pressure balancing aperture, being disposed at the top of the suction type spray head and penetrating the top of the suction type spray head for the outside air communicating with inner side of the cap for pressure inside a container, which is joined to the cap and filled with liquid, keeping the same as the outside air;

a suction mouth, being disposed uprightly at the top of the cap next to the air spray outlet of the air outgoing passage and communicating with the inner side of the cap; and a suction tube, being disposed in the cap and extending downward with an upper end thereof being arranged right under the suction mouth and the lower end thereof entering the container;

whereby, while the discharge port is blocked with a finger of a user, the outside air is introduced to the air guiding chamber via the intake passage before entering the outgoing passage via the air inlet and then the air passes through the outgoing passage and sprays outward via the air outlet with fast flowing speed and air pressure less than atmosphere such that liquid in the container is sucked outward the suction mouth along the suction tube and atomized by the air spraying from the air outlet; and while the discharge port is not blocked with the finger, the air in the air guiding chamber moves outward via the discharge port instead of entering the outgoing passage and spraying outward via the air outlet such that the liquid is not sucked outward via the suction mouth and not atomized by the air spraying from the air outlet.

* * * * *